United States Patent [19]

Michel et al.

[11] Patent Number: 4,533,438

[45] Date of Patent: Aug. 6, 1985

[54] METHOD OF PYROLYZING BROWN COAL

[75] Inventors: Wolfgang Michel, Magdeburg; Heinz Paul, Möser; Andreas Rummel, Dessau; Gero Seher, Wernigerode; Manfred Ossowski, Magdeburg; Irmtrud Heberlein, Möser, all of German Democratic Rep.

[73] Assignee: VEB Schwermaschinenbau "Karl Liebknecht" Magdeburg, Magdeburg, German Democratic Rep.

[21] Appl. No.: 562,504

[22] Filed: Dec. 16, 1983

[30] Foreign Application Priority Data

Mar. 23, 1983 [DD] German Democratic Rep. ... 249079

[51] Int. Cl.[3] ..... C10B 49/10

[52] U.S. Cl. ..... 201/31; 48/210; 201/29; 201/36

[58] Field of Search ..... 201/14, 29, 31, 36; 48/210; 208/8 R, 11 R

[56] References Cited

U.S. PATENT DOCUMENTS

| | | | |
|---|---|---|---|
| 3,130,133 | 4/1964 | Loevenstein | 201/31 |
| 3,565,766 | 2/1971 | Eddinger et al. | 201/31 |
| 4,056,443 | 11/1977 | Colletta et al. | 201/31 |
| 4,069,024 | 1/1978 | Fernandes | 201/31 |

FOREIGN PATENT DOCUMENTS

| | | | |
|---|---|---|---|
| 2553760 | 6/1977 | Fed. Rep. of Germany | 201/31 |
| 874302 | 8/1961 | United Kingdom | 201/31 |

*Primary Examiner*—Peter Kratz
*Assistant Examiner*—Mike McGurk
*Attorney, Agent, or Firm*—Jordan and Hamburg

[57] ABSTRACT

A two-step method and apparatus, according to the fluidized bed principle, for the production of coke, rich gas and pyrolysis tar, with the object of executing the method in a compact apparatus arrangement, with high energy efficiency and high throughput capacity.

This is accomplished by a sequence in which the fine grains removed from the drying vapor mixture are removed from the actual pyrolysis process, and a hot gas, alien to the carbonization, is used as fluidization medium in the pyrolysis reactor, and with a hot gas-high performance separator being used for the dust separation from the pyrolysis gas, with the combustion exhaust gas produced in the combustion chamber being used for the indirect heating of the fluidization medium, for the pre-heating of the gas, which is alien to the carbonization, and for the direct heating in the dryer. The dryer has a double casing in the area of the fluidized bed, and a mixing chamber is arranged directly underneath its initial flow bottom, while the pyrolysis reactor is directly connected to the combustion chamber and the pre-heater.

15 Claims, 1 Drawing Figure

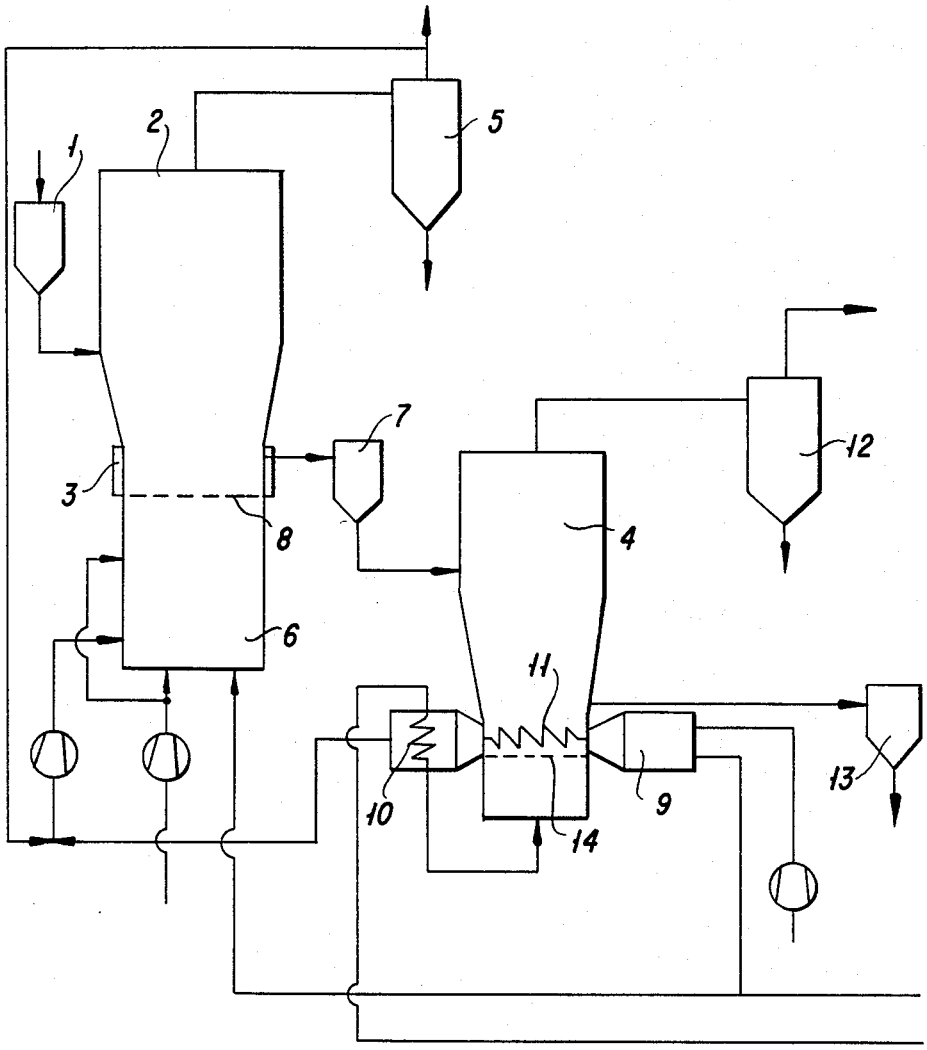
1
2
3
4
5
6
7
8
9
10
11
12
13
14

METHOD OF PYROLYZING BROWN COAL

FIELD OF APPLICATION FOR THE INVENTION

The invention relates to a two-step method for the rapid pyrolysis of freshly mined brown coal, such coal being rich in ash and saliferous, and preferably of soft brown coal, according to the fluidized bed principle, as well as an apparatus for the execution of this method, for the simultaneous production of high grade coke, rich gas and a pyrolysis tar with low dust content.

Methods and apparatus are known, according to which a carbonization or coking of the coal takes place in one, two or three process steps, with the object of producing mainly one of the three main products, coke, tar or gas.

DD-PS No. 48 389 describes a method for the short time carbonization of solid fuels, high in inerts and non-briquetted, intended mainly for the production of tar, and with gas and coke produced as incidental by-products. The fuel, which is to be carbonized, is initially supplied to a pre-dryer, having a grate and working according to the fluidized bed principle. This pre-dryer has a combustion chamber, in which part of the carbonization gas is burned to flue gas, and in which part of the drying vapors from the pre-dryer is added as fluidizing gas. This mixture adds the heat to the fluidized bed, which is formed in the pre-dryer. The highly pre-dried coal is slagged for a short time over the grid by a feeder, and supplied to somewhat deeper lying carbonizing aggregate. This works with a fluidized bed as well, constructed on a grate. The heat is added by carbonization gas combustion in a combustion chamber, arranged to the carbonizing aggregate, by adding cold carbonization gas as fluidizing gas. It should be noted that in this method the dust from the dust separator, connected to the pre-dryer, is brought into the fluidized bed up to the vicinity of the grate of the carbonizing aggregate via an immersion tube. Residual oils, asphalts and other heavy carbons can be brought into the fluidized bed as well, with the yield of lighter liquid products being improved, with simultaneous reconditioning of useless residuals.

The carbonized coals are supplied to an additional utilization point via a discharge arrangement. The hot carbonization gas from the carbonizing aggregate arrives either via a separator or is supplied to a cracking unit, in which the tar vapors are split and the coke dust separated. Subsequently, there is further condensation of the tar vapors. The detarred carbonization gas is returned to the process mainly in the form of hot gas or cleansing gas via a blower. Only minimal amounts can be released as surplus gas.

It is a disadvantage of this method that the two-step short time carbonizing method mainly concentrates on one main product, tar, while gas and coke are produced as by-products. Carbonization gas is led in a cyclic course. It is burned to combustion-exhaust gas in the combustion chamber of the pre-dryer, as well as in the combustion chamber of the carbonizing aggregate, with part of the produced carbonization gas being reused.

The introduction of the dust from the drying vapor mixture into the carbonizing aggregate at prevailing temperatures leads to an increase of the dust content of the tar vapors being formed there. The result is an unfavorable ratio of dust-poor heavy tar to dust-rich tar.

Because of the low reaction temperatures, this method results in only minimal coke yields.

DE-AS No. 25 53760 discloses an additional method for the carbonization of granular coal and an apparatus for the execution of this method. This is a three-step method, directed towards the production of three main products; coke, gas and maximal tar yield. The coals are pre-dried in a pre-dryer until only minimal residual moisture remains and subsequently separated into cyclones according to grain size, which are then supplied in various heights to a pre-heater at approximately 300° C. Exhaust gas is used for the heating and serves as carrier gas. Following the pre-heating, the coals are again separated from the carrier gas in connected cyclones and supplied to the fluidized bed ovens. At approximately 600° C. carbonization occurs, with the required heat being indirectly supplied to the fluidized bed ovens. Carbon dioxide serves as heat carrier for the indirect heating of the fluidized bed, the carbon dioxide being supplied in a cyclic course. The carbon dioxide is heated in a pre-heater to approximately 900° C., and releases its heat to the fluidized bed via a heat exchanger, which is directly connected to the fluidized bed oven, and returns to the pre-heater at approximately 650° C. The method allows an increase of the heat amount in the fluidized bed, by supplying air of combustion. The carbonization gas, preheated to 600° C., serves as cleansing gas. The products are after-treated in a well-known fashion, and supplied to their respective utilization purposes. The described method overcomes some disadvantages of the state of the art, however, it requires high expenditures as regards material, production technique, as well as expenditures specific to plants and adjuvants. These high expenditures represent the main disadvantage of this method.

SUMMARY OF THE INVENTION

It is an object of the present invention to develop a method for the rapid pyrolysis of freshly mined brown coal, which is rich in ash and saliferous, especially of soft brown coal, and an apparatus for the execution of this method, allowing for the production of the main products, coke, gas and tar of high quality, and in high quantities. The method displays high energy efficiency, the arrangement has a high throughput capacity relative to the expenditures pertaining to the apparatus, the plant and the adjuvants remaining low.

It is another object of the invention to develop a two-step method for the rapid pyrolysis of freshly mined brown coal, rich in ash and saliferous, preferably soft brown coal, as well as an apparatus for the execution of the method according to the fluidized bed principle, serving for the simultaneous production of a high-quality coke, a rich gas and a pyrolysis tar with low dust content, particularly suitable for electrode coke production.

The basis of the invention lies in a method, in which the coal is dried in a dryer by a fluidization medium, located above an initial flow bottom. It is furthermore an object of the invention to avoid an agglomeration of the coals at drying temperatures below the condensation levels of tar forming vapors, especially in the border zones of the fluidized bed.

The drying vapor mixture removed from the dryer is supplied to a separator for fine grain separation. The dried coals are subsequently supplied to a carbonizing reactor, having a heat exchanger arranged in it for the indirect heating of the fluidized bed. By means of carbonization gas, the coal is carbonized.

It is furthermore another object of the invention to achieve a shaft stress of the dryer and the pyrolysis reactor which is larger than 2 $t/m^2h$. Furthermore, the parts of the apparatus are closely arranged to one another, so that the entire arrangement requires little space and is power efficient.

These and other objects and advantages of the present invention will become evident from the description which follows.

The technical task is solved in the invention in that the present fine grain removed from the drying vapor mixture is removed from the actual rapid pyrolysis process and that a gas, containing hydrocarbon, alien to the carbonization, with a temperature corresponding to the pyrolysis conditions, is used as fluidization medium in the pyrolysis reactor. Furthermore, it is provided that a hot-gas performance dust separator is used to separate the dust from the pyrolysis gas of the pyrolysis reactor, achieving a degree of purity which is less than 100 mg dust/$Nm^3$ pyrolysis gas. Furthermore, the combustion gas, produced in the combustion chamber, is used for the indirect heating of the fluidized bed, for the preheating of the gas containing hydrocarbon and alien to the carbonization, and as a mixing component for the direct heating in the dryer.

The arrangement in the invention provides for the dryer to have a double casing in the area of the fluidized bed, and a mixing chamber directly underneath its initial flow bottom, with the combustion chamber and a preheater being pressure-tightly arranged on the pyrolysis reactor.

The invention accordingly consists in the method and apparatus for the rapid pyrolysis of brown coal as described supra, and as will appear infra from the description relative to the drawing, and as specified in the recitations in the appended claims.

BRIEF DESCRIPTION OF THE DRAWINGS

The invention will be explained in detail by means of an embodiment. The explanation is based on the method flowsheet and apparatus shown in the drawing. The method is divided into two steps; the drying of the freshly mined soft brown coal (raw brown coal), and its subsequent pyrolysis for the simultaneous production of coke, gas and tar with low dust content.

Following is a glossary of reference elements and members as employed in the present invention.

| GLOSSARY | |
|---|---|
| 1. Coal Bunker | 8. Initial flow bottom (in the dryer) |
| 2. Dryer | 9. Combustioon chamber |
| 3. Double casing | 10. Pre-heater |
| 4. Pyrolysis reactor | 11. Heat exchanger |
| 5. Separator | 12. Hot gas-high performance separator |
| 6. Mixing chamber | 13. Coke bunker |
| 7. Intermediate bunker | 14. Initial flow bottom (in the pyrolysis reactor) |

DETAILED DESCRIPTION OF THE PREFERRED EMBODIMENTS

Referring now to the drawing, the soft brown coals arrive in the upper part of a dryer 2 from a coal bunker 1, with the coal input occurring via any type of conveyance means. The dryer 2 essentially consists of an initial flow bottom 8, on which the fluidized bed is formed. A mixed gas is used as initial flow or fluidization medium, to which drying vapor gas has been added. The mixed gas is formed by burning town gas with air in a screwed on mixing chamber 6, located directly underneath the initial flow bottom 8, exiting at a temperature of approximately 350° C. through the initial flow bottom 8. The temperature developing in the fluidized bed is 200° C. at a maximum. The separation of the dried brown coal dust from the vapor gas occurs in the dust separator 5. Suitable blowers keep the reaction conditions constant, especially the oxygen content and positive pressure. The high heating velocity achieved by the fluidized bed, combined with the temperature and the flow velocity of the fluidization medium, assures the desired high coal throughput, and keeps the degree of oxidation of the coals used within the limits for the required quality of the final products, gas, coke and tar. Uniform or a constant level of heating is indirectly achieved by means of the heated double casing 3 about the edge of the fluidized bed. An adhering of the coals to the dryer walls or an agglomeration of the coals in the border zones of the fluidized bed is thus prevented.

The dried coal is slagged above the initial flow bottom 8 via a discharge drain and transported into an intermediate bunker 7 by any type of conveyance means. The discharge drain simultaneously serves to regulate the fluidized bed height and thus sets the time the coal remains in the fluidized bed.

From the intermediate bunker 7, the dried coal arrives in the fluidized bed of the pyrolysis reactor 4. This operates with a fluidized bed as well, constructed on the initial flow bottom 14. The heat input occurs, on the one hand, indirectly via a heat exchanger 11, arranged in the fluidized bed, and, on the other hand, via heated gas, alien to the carbonization, such as, for example, natural gas. This is pre-heated in a pre-heater 10, directly mounted on the pyrolysis reactor 4, and flows through the heat exchanger 11 and is thus heated and expanded, so that reaction temperatures of 550° C. to 600° C. are present in the fluidized bed of the pyrolysis reactor 4. Analogous to the pre-heater 10, a combustion chamber 9 is arranged mounted directly on the pyrolysis reactor 4. Here, town gas is burned to combustion exhaust gas with a temperature of approximately 1300° C.

From the combustion chamber 9, the hot combustion exhaust gas enters through the tube channels of the heat exchanger 11 and indirectly delivers heat to the fluidized bed. The combustion exhaust gas then enters the pre-heater 10 with a temperature of approximately 900° C. to 950° C. and serves for the indirect pre-heating of the gas, which is alien to the carbonization. Furthermore, the combustion exhaust gas is then used as a mixing component for the direct heating in dryer 2.

The removal of the carbonized coke produced in the pyrolysis reactor 4 occurs, analogous to the dryer 2, via a discharge drain in the bunker 13, so that the time the coal remains in the fluidized bed is influenced by the coke discharge. The vapor mixture containing gas, leaves the pyrolysis reactor 4 at a temperature of 450° C. and enters a hot gas-high performance separator 12. The fine grains are separated and supplied to a storage tank. Subsequently, the finest grains are separated. Thereafter, the carbonized tar is condensed in special pre- and after coolers and collected and stored in special tar storage tanks.

Compared to other techniques, the invention displays the following distinct advantages:

The three products, gas, coke and tar are produced simultaneously, being of high quality and in high quantities. The freshly mined soft brown coal, being rich in ash and saliferous, undergoes a drying and subsequently rapid pyrolysis process according to the fluidized bed principle. The arrangement is compact with the apparatus elements being arranged directly adjacent to one another, in order to avoid heat and energy losses. The problem with agglomeration of the coals on the dryer walls in the area of the fluidized bed is solved during drying processes at temperatures below vapor separation and condensation by a heatable double casing assuring a constant heating level in these border zones. A gas, which is alien to the carbonization, is finally used as fluidization medium, heated and expanded, leading to higher gas yields. The removal of the fine grains from the drying vapor mixture leads to a lowering of the dust content of the carbonization gas and, following the separation of the finest grains, leads to a pyrolysis tar suitable for electrode coke treatment.

The high energy efficiency of the method is especially achieved by the following factors:

- the combustion gas produced in the combustion chamber
  1. serves for the indirect heating of the pyrolysis reactor fluidized bed,
  2. is used for the pre-heating of the gas, alien to the carbonization, and
  3. is used as a mixing component for the direct heating in the dryer.
- the drying vapor gas formed during the first process step in the dryer is transported in a cyclic course,
- the sensible heat of the coke is used in connection with its reactivity by coupling with a directly connected method such as, for example, gasification, combustion or coking.

A shaft stress of more than 2 $t/m^2h$, at low plant technical expenditures and correspondingly low specific investment costs, can be achieved.

It thus will be seen that there is provided a method and apparatus for the rapid pyrolysis of brown coal which attains the various objects of the invention and which is well adapted for the conditions of practical use. Numerous alternatives within the scope of the present invention will occur to those skilled in the art, besides those alternatives, embodiments, equivalents and variations mentioned supra, and it therefore will be understood that the present invention extends fully to all such alternatives and the like, and that the invention is to be limited only by the scope of the recitations in the appended claims, and functional and structural equivalents thereof.

We claim:

1. A two stage method for the rapid pyrolysis of brown coal, said brown coal being rich in ash and saliferous, so as to simultaneously produce high grade coke, a rich pyrolysis exit gas stream of low dust content, and a pyrolysis tar stream of low dust content, which comprises (a) providing a feed stream of solid particulate mined brown coal, said brown coal being rich in ash and saliferous;

(b) fluidizing and drying said brown coal feed stream in a first fluidized bed stage, by passing said brown coal feed stream into said first fluidized bed and above a first foraminous initial flow bottom support disposed below said first fluidized bed, said first fluidized bed and said first support being within a first container comprising a dryer means;

(c) burning a flammable gas stream with an air stream within a mixing chamber within said first container dryer means and below said first support, and concomitantly passing a recycle drying vapor gas stream and a combustion exhaust gas stream into said mixing chamber, so that hot mixed gas rises from said mixing chamber and through said first support, and fluidizes and heats said brown coal feed stream within said first fluidized bed, whereby said brown coal feed stream is dried in said first fluidized bed and within said first container dryer means by direct heating, with a limited degree of oxidation of the brown coal taking place in said first fluidized bed;

(d) withdrawing a drying vapor gas mixture stream from said first container dryer means, and from above said first fluidized bed, said drying vapor gas mixture stream containing a first quantity of entrained solid particulate material in the form of fine grains and dust;

(e) separating said first quantity of entrained solid particulate material from said drying vapor gas mixture stream;

(f) dividing the drying vapor gas stream derived from step (e) into two portions, a first portion being said recycle drying vapor gas stream of step (c), and a second portion being a discharged-off gas;

(g) withdrawing a dried coal stream from said first container dryer means, and from said first fluidized bed;

(h) carbonizing the withdrawn dried coal stream of (g) by rapid pyrolysis, and in a second fluidized bed stage, by passing said dried coal stream into said second fluidized bed and above a second foraminous initial flow bottom support disposed below said second fluidized bed, said second fluidized bed and said second support being within a second container comprising a pyrolysis reactor;

(i) providing a hot gas stream containing hydrocarbon and alien to carbonization, and comprising a fluidizing medium, said hot hydrocarbon-containing gas stream being at a temperature corresponding to the pyrolysis conditions in said second container pyrolysis reactor of (h);

(j) passing said hot hydrocarbon-containing gas stream of (i) into said second container pyrolysis reactor below said second support, whereby said hot hydrocarbon-containing gas stream rises through said second support, and fluidizes and carbonizes said dried coal stream in said second fluidized bed, acting as a fluidizing medium and by rapid pyrolysis of said dried coal stream, said second fluidized bed being concomitantly heated by indirect heat exchange with a hot heat exchange fluid stream, the heat exchange fluid stream thereafter being passed into the said mixing chamber as combustion exhaust gas stream of step (c);

(k) withdrawing a pyrolysis exit gas stream from said second container pyrolysis reactor, and from above said second fluidized bed, said pyrolysis exit gas stream containing a second quantity of entrained solid particulate material in the form of fine grains and dust;

(l) separating said second quantity of entrained solid particulate material from said pyrolysis exit gas stream;

(m) cooling the cleaned pyrolysis exit gas stream derived from step (l), so as to condense and separate a product pyrolysis tar stream of low dust content from a product rich pyrolysis exit gas stream of low dust content; and (n) withdrawing a product coke stream from said second container pyrolysis reactor, and from said second fluidized bed.

2. The two stage method for the rapid pyrolysis of brown coal of claim 1, in which the flammable gas stream of step (c) comprises town gas.

3. The two stage method for the rapid pyrolysis of brown coal of claim 1, in which the hot gas stream containing hydrocarbon and alien to carbonization of step (i) is a hydrocarbon-containing gas stream selected from the group consisting of methane and natural gas.

4. The two stage method for the rapid pyrolysis of brown coal of claim 1, in which the hot heat exchange fluid stream of step (j) is a combustion exhaust gas stream, produced by burning a flammable gas stream with an air stream in a combustion chamber, said combustion chamber discharging the hot combustion exhaust gas stream into indirect heat exchange means disposed within the second fludized bed, the hot combustion exhaust gas stream being partially cooled in said indirect heat exchange means, to produce a partially cooled combustion exhaust gas stream, which is discharged from said indirect heat exchange means.

5. The two stage method for the rapid pyrolysis of brown coal in claim 4, in which the flammable gas stream comprises town gas.

6. The two stage method for the rapid pyrolysis of brown coal of claim 4, in which the partially cooled combustion exhaust gas stream discharged from the indirect heat exchange means is passed into indirect heat exchange with a hydrocarbon-containing gas stream alien to carbonization, so as to heat said hydrocarbon-containing gas stream alien to carbonization, and thereby produce the hot gas stream containing hydrocarbon and alien to carbonization and comprising a fluidizing medium of step (i) of claim 1, and a further cooled combustion exhaust gas stream.

7. The two stage method for the rapid pyrolysis of brown coal of claim 6, in which the further cooled combustion exhaust gas stream is the combustion exhaust gas stream which is passed into the mixing chamber within the dryer means according to step (c) of claim 1.

8. The two stage method for the rapid pyrolysis of brown coal of claim 1, in which the first container dryer means is externally insulated about and external to the first fluidized bed, so as to provide a constant level of uniform heating in the first fluidized bed, and so as to prevent adhering of the particles of the brown coal feed stream to the walls of the first container dryer means, or an agglomeration of the particles of the brown coal in the border zones of the first fluidized bed, or at a drying temperature below the condensation levels of tar forming vapors.

9. The two stage method for the rapid pyrolysis of brown coal of claim 8, in which the first container dryer means is externally insulated by providing external insulation comprising doubly casing the portion of the first container dryer means external to the first fluidized bed.

10. The two stage method for the rapid pyrolysis of brown coal of claim 9, further comprising heating the doubly cased portion of the first container dryer means external to the first fluidized bed.

11. The two stage method for the rapid pyrolysis of brown coal of claim 1, in which the product rich pyrolysis exit gas stream of low dust content of step (m) has a degree of purity which is less than 100 milligrams of dust per normal cubic meter of pyrolysis gas.

12. The two stage method for the rapid pyrolysis of brown coal of claim 1, in which the product pyrolysis tar stream of low dust content of step (m) is suitable for electrode coke production.

13. The two stage method for the rapid pyrolysis of brown coal of claim 5, in which the shaft weight stress of the dryer means and the pyrolysis reactor is greater than 2 tons per square meter per hour.

14. The two stage method for the rapid pyrolysis of brown coal of claim 1, in which the brown coal is freshly mined soft brown coal.

15. The two stage method for the rapid pyrolysis of brown coal of claim 1, in which the hot mixed gas stream rising from the mixing chamber and through the first support in step (c) is at a temperature of about 350° C., the maximum temperature developed in the first fluidized bed of step (c) is about 200° C., the reaction temperature in the second fluidized bed of step (j) is in the range of about 550° C. to 600° C., the initial temperature of the hot heat exchange fluid of step (j) is about 1300° C. and the hot heat exchange fluid of step (j) is cooled to a final temperature in the range of about 900° C. to about 950° C. by the indirect heat exchange with the second fluidized bed, and the temperature of the pyrolysis exit gas stream withdrawn according to step (k) is about 450° C.

* * * * *